US010760574B2

(12) United States Patent
De Bock et al.

(10) Patent No.: US 10,760,574 B2
(45) Date of Patent: Sep. 1, 2020

(54) COMPRESSOR ELEMENT FOR A SCREW COMPRESSOR AND SCREW COMPRESSOR IN WHICH SUCH A COMPRESSOR ELEMENT IS APPLIED

(71) Applicant: ATLAS COPCO AIRPOWER, NAAMLOZE VENNOOTSCHAP, Wilrijk (BE)

(72) Inventors: Simon Peter G. De Bock, Wilrijk (BE); Johan Nachtergaele, Wilrijk (BE); Dieter Manille L. Bertels, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 275 days.

(21) Appl. No.: 15/566,531

(22) PCT Filed: Apr. 12, 2016

(86) PCT No.: PCT/BE2016/000016
§ 371 (c)(1),
(2) Date: Oct. 13, 2017

(87) PCT Pub. No.: WO2016/164988
PCT Pub. Date: Oct. 20, 2016

(65) Prior Publication Data

US 2018/0298904 A1 Oct. 18, 2018

(30) Foreign Application Priority Data

Apr. 17, 2015 (BE) ..... 2015/05250

(51) Int. Cl.
*F01C 1/16* (2006.01)
*F03C 2/00* (2006.01)
(Continued)

(52) U.S. Cl.
CPC ..... *F04C 29/0021* (2013.01); *F04C 18/086* (2013.01); *F04C 18/16* (2013.01);
(Continued)

(58) Field of Classification Search
CPC ..... F04C 18/086; F04C 18/16; F04C 29/005; F04C 29/0071; F04C 2240/30; F04C 2240/50; F04C 29/0021
(Continued)

(56) References Cited

U.S. PATENT DOCUMENTS 5,413,467 A * 5/1995 Suzuki ..... F04C 18/16 418/201.1
5,417,551 A * 5/1995 Abe ..... F04C 18/16 418/201.1
(Continued)

FOREIGN PATENT DOCUMENTS

CN 103109090 A 5/2013
DE 3810505 A1 10/1989
(Continued)

OTHER PUBLICATIONS

DE-19849098-A1—Bahnen Rudolf—Eccentric Screw Pump for Gases as Vacuum Pump uses on-turn Inner Rotor rotating without contact inside Housing Rotor with Scoop Space—Apr. 27, 2000—English Translation (Year: 2000).*
(Continued)

*Primary Examiner* — Theresa Trieu
(74) *Attorney, Agent, or Firm* — Bacon & Thomas, PLLC

(57) ABSTRACT

A compressor element of a screw compressor inlet side and an outlet side and two helical rotors, respectively a male rotor with a drive for the male rotor and a female rotor that is driven by the male rotor by means of synchronisation gearwheels with at least one synchronisation gearwheel on the male rotor, wherein the drive and synchronisation gear-
(Continued)

wheels of the male rotor are chosen such that, upon being driven with acceleration of the rotors without gas forces, the resulting mechanical drive force that is exerted by this drive and by this synchronisation gearwheel on the male rotor has an axial component that is directed from the outlet side to the inlet side and that the movement of the male rotor in the axial direction from the outlet side to the inlet side is fixed by means of a single axial single-acting or double-acting bearing.

18 Claims, 2 Drawing Sheets

(51) Int. Cl.

| | |
|---|---|
| ***F03C 4/00*** | (2006.01) |
| ***F04C 18/00*** | (2006.01) |
| ***F04C 29/00*** | (2006.01) |
| ***F04C 18/16*** | (2006.01) |
| ***F04C 18/08*** | (2006.01) |

(52) U.S. Cl.
CPC ..... *F04C 29/005* (2013.01); *F04C 29/0071* (2013.01); *F04C 2240/30* (2013.01); *F04C 2240/50* (2013.01)

(58) Field of Classification Search
USPC ..... 418/101, 201.1–201.3, 203
See application file for complete search history.

(56) References Cited

U.S. PATENT DOCUMENTS

| | | | | |
|---|---|---|---|---|
| 5,599,176 | A | 2/1997 | Reinersmann | |
| 6,287,088 | B1 † | 9/2001 | Nishimura | |
| 2002/0037229 | A1 | 3/2002 | Sjoholm et al. | |
| 2013/0101390 | A1 * | 4/2013 | Nachtergaele | F04D 27/00 417/365 |

FOREIGN PATENT DOCUMENTS

| | | | | |
|---|---|---|---|---|
| DE | 19849098 | A1 * | 4/2000 | F04C 18/107 |
| EP | 0154673 | A2 † | 9/1985 | |
| EP | 0666422 | A1 | 8/1995 | |
| JP | S57105584 | A | 7/1982 | |
| JP | S5867987 | A | 4/1983 | |
| JP | S5874889 | A | 5/1983 | |
| JP | S6018285 | U | 2/1985 | |
| JP | S614889 | A | 1/1986 | |
| JP | 01015484 | A * | 1/1989 | F04C 18/16 |
| JP | 06159280 | A * | 6/1994 | F04C 18/16 |
| JP | 2007113588 | A | 5/2007 | |

OTHER PUBLICATIONS

Konka, Karl-Heinz: Schrauben Kompressoren Technik and Praxis, VDI-Verlag GmbH, Dusseldorf, 1988, pp. 312-317 (see attached NPL document in the IDS.3P filed on Jan. 31, 2019). (Year: 1988).*

Brändlein et. al. 'Ball and Roller Bearings—Theory, Design and Application'; Third Edition, 1999, John Wiley & Sons Ltd., Chichester, 199, p. 515-519.

Bearings in twin screw compressors. Application handbook; 1998, SKF USA Inc.; publication 100/956, 199, p. 9-11.

Chinese Office Action in related Chinese Application No. 201680030019.8, dated Sep. 26, 2018.

International Search Report (ISR) dated Oct. 17, 2016, for PCT/EP2016/000016.

Konica, Karl-Heinz: Schrauben Kompressoren Technik and Praxis, VDI-Verlag GmbH, Dusseldorf, 1988, pp. 312-317.†

SKF: Bearings in twin screw compressors. Application Handbook. SKF USA Inc., publication 100/956, 1998.†

Brändlein J., Eschmann P., Hasbargen L, Weigand K.: Ball and Roller Bearings. Theory, Design and Application. Third edition, John Wiley & Sons Ltd., Chishester, 1999, pp. 515-519.†

* cited by examiner
† cited by third party

COMPRESSOR ELEMENT FOR A SCREW COMPRESSOR AND SCREW COMPRESSOR IN WHICH SUCH A COMPRESSOR ELEMENT IS APPLIED

The present invention relates to a compressor element of a screw compressor for compressing a gas.

BACKGROUND OF THE INVENTION

Known compressor elements for the said type comprise a housing with an inlet for the gas on the inlet side and an outlet for the gas on the outlet side and two rotor chambers in which two helical rotors are mounted on bearings that mesh together when driven to compress the gas, respectively a male rotor with a drive gearwheel for driving the male rotor by a gearwheel transmission and a female rotor that is driven by the male rotor by means of synchronisation gearwheels with at least one synchronisation gearwheel on the male rotor and one synchronisation gearwheel on the female rotor, whereby the synchronisation gearwheels are generally designed such that, when driven, the male rotor rotates faster than the female rotor.

By driving the compressor element, chambers are formed between the two rotors that are filled with gas at the inlet, whereby upon the rotation of the rotors these chambers move from the inlet side to the outlet side and become increasingly smaller, such that the enclosed gas is compressed and which is delivered at a higher pressure to a downstream consumer network via a pressure pipe connected to the outlet.

Due to the compression, forces are exerted by the gases on the rotors that tend to push the rotors away from the outlet side in the direction of the inlet side.

The drive gearwheel on the male rotor is chosen such that when driven by the drive gearwheel a force is exerted with an axial component that is directed from the inlet to the outlet, thus oriented opposite to the axial component of the force exerted by the gas on the male rotor, so that this gas force is partially offset by the driving force of the drive gearwheel, so that the axial bearings are exposed to smaller forces.

The synchronisation gearwheels also exert a force on the rotors, whereby this force on the male rotor generally adds to the gas force on this rotor, while in the case of the female rotor this force counteracts the gas force.

When the compressor element is driven unloaded, in other words without compressed gas having to be supplied, the gas forces are non-existent or minimal, such that the composite forces of the drive gearwheel and the synchronisation gearwheels could tend to push the rotors in the opposite direction towards the outlet, in contrast to the loaded situation with the supply of compressed gas.

During dynamic transitional modes, forces can occur that push the rotors in the one or the other direction.

All this means that the direction of the composite forces that are exerted on the rotors depends on the mode, loaded or unloaded, and the fact that the situation is static or dynamic, such that in some circumstances these forces tend to push the rotors against the inlet end face of the housing on the inlet side, and in other circumstances against the outlet end face of the housing on the outlet side.

To prevent the rotors coming into contact with one of the two end faces of the housing, the rotors are generally axially fixed by two axial bearings, more specifically one on the inlet side and one on the outlet side, complemented with a radial bearing on either side of the rotors.

It is known to provide compressor elements of the screw type with means in the form of a spring or a plunger to exert an additional mechanical axial force or prestress force on each rotor, in order to relieve the bearings and/or to prevent, in the absence of gas forces in the unloaded mode, the rotors being pushed or pulled by the axial drive forces of the drive gearwheel and the synchronisation gearwheels against the housing. These means are generally built into the bearing cover, such that it must be made extra thick and heavy.

A disadvantage of such force means is that it detrimentally affects the costs of the compressor element and that in some circumstances it also increases the load on the bearings instead of offsetting them such that larger bearings are required.

If plungers are used as a force means, the exerted force can be controlled, but such a control entails extra costs, makes the compressor element more vulnerable to possible breakdowns and increases the size and mass of the bearing cover and therefore also the forces and vibrations on the housing of the compressor element.

The axle journal of the male rotor on which the drive gearwheel is mounted experiences a relatively high bending force due to the radial forces that are exerted by the drive gearwheel on it. This has the disadvantage that in certain extreme conditions the axial bearing of the male rotor that is mounted on this axle journal can tilt, which can lead to a limitation of the operating region of the compressor element.

The known compressor elements of the discussed type are outlet driven, which means that the gearwheel transmission with the drive gearwheel is on the hot outlet side of the compressor element, whereby the axial bearing on this side of the rotors is in contact with the less pure environment of the gearwheel transmission, which can affect their lifetime. This axial bearing is called the main bearing and its primary function is to retain the rotor concerned locally in the axial direction.

Due to a varying temperature gradient in the axial direction of the rotors as a function of the mode of the compressor element, changes also occur in the length of the shaft of the rotors, whereby different temperatures of the male and the female rotors lead to different length changes of the two rotors and thus a change in the mutual axial position of both synchronisation gearwheels. This mutual axial displacement of the synchronisation gearwheels, in the event of synchronisation gearwheels with oblique toothing, has the undesired effect that the synchronisation between the rotors changes with the temperature.

With the known outlet-driven compressor elements the synchronisation gearwheels are on the inlet side in other words on the opposite side of the rotor where the main bearing is located and thus at a relatively large distance from this main bearing, such that the synchronisation gearwheels experience a significant mutual axial displacement due to the differential length variations of the rotors as a result of varying temperature gradients, with the disadvantage that in the case of synchronisation gearwheels with oblique toothing, the synchronisation change between the male and the female rotor can be undesirably large.

SUMMARY OF THE INVENTION

The purpose of the present invention is to provide a solution to one or more of the aforementioned and other disadvantages.

To this end the invention concerns a compressor element of a screw compressor for compressing gas, with the compressor element comprising a housing with an inlet for the gas on the inlet side, and an outlet for the gas on the outlet side and a rotor chamber in which two helical rotors are mounted on bearings that upon being driven mesh together in order to compress the gas, respectively a male rotor with a drive for the male rotor and a female rotor that is driven by the male rotor by means of synchronisation gearwheels with at least one synchronisation gearwheel on the male rotor and one synchronisation gearwheel on the female rotor, whereby the drive and synchronisation gearwheels of the male rotor are chosen such that, upon being driven with acceleration of the rotors of the compressor element without gas forces, the resulting mechanical drive force that is exerted by this drive and by this synchronisation gearwheel on the male rotor has an axial component that is directed from the outlet side to the inlet side and whereby the movement of the male rotor in the axial direction from the outlet side to the inlet side is fixed by means of a single axial single-acting or double-acting bearing.

Driving without gas forces means a drive whereby the rotors are hypothetically driven in the way for which the drive of the male rotor is intended, however without a gas pressure being able to build up, for example by letting the rotors rotate in an open housing and thus disregarding the effects of the gas forces, which together with the mechanical transmission forces can affect the direction in which the drive force exerted by the synchronisation gearwheel of the male rotor on this rotor and which can even reverse this direction of the drive force in the event of large gas forces, whereby in such a case the female rotor can be braked by the synchronisation gearwheels instead of being driven by them.

Due to this choice of drive and gearwheels it is ensured that the resulting axial drive force exerted on the male rotor is always directed in the same direction as the gas forces, i.e. from the outlet side to the inlet side.

Even in conditions when there are no gas forces, or when these gas forces are low, the rotor only experiences a drive force that is oriented in this same direction, i.e. from the outlet side to the inlet side.

This has the advantage that the male rotor is always pushed in the same direction towards the inlet side and that it is sufficient to fix the male rotor axially by means of a single axial bearing to prevent the end face on the inlet side of the male rotor being pushed against the inlet end face of the housing and that, as the forces act in one direction, the rotor cannot run up against the outlet end face.

This provides the advantage that in the case of the invention, a single axial bearing on one side of the male rotor is sufficient, in contrast to the known screw compressors in which an axial bearing is applied on either side of the male rotor of the compressor element.

An advantage of only one axial bearing is that the mechanical losses in the bearings can be reduced as a result, especially in view of the fact that the male rotor is the faster rotating rotor of the two rotors.

Another advantage is that the sole axial bearing of the male rotor, more specifically the 'main bearing', as it were forms a single fixed point where the male rotor is axially held and that in this case there is no second axial bearing that generates an extra prestress force on the main bearing. An advantage attached to this is that any change of length of the male rotor as a result of the temperature does not mean any further change of shape for the pretension spring, so that no extra force changes occur here.

As the axial forces on the male rotor are always directed in the same direction, a single-acting axial bearing is sufficient, although the invention does not exclude a double-acting axial bearing being used as an alternative when for example, in exceptional cases, the combined axial forces on the male rotor could briefly change direction due to dynamic effects in the change from one mode to another.

A single-acting axial bearing provides the advantage of being more efficient.

For the same reason that the joint forces on the male rotor always act in the same direction, no force-compensating means are required for the male rotor such as a spring or plunger to obtain an axial prestressing of the male rotor, not even with the unloaded rotation of the compressor element.

This means a simplification of the compressor element with respect to the known compressor elements for screw compressors, resulting in fewer components and thus also less risk of failure.

In certain cases, the omission of the force-compensating means also ensures a lower axial load of the axial bearing, such that a smaller bearing can be selected and as a result a higher speed of the male rotor is possible at speeds that have not been considered possible up until now.

An additional advantage is that in the cover of the synchronisation gearwheels no space has to be provided to accommodate the force-compensating means, such that this cover can be made less high and lighter and the bearing is easily accessible for assembly.

Preferably the compressor element is an inlet-driven compressor element, in other words a compressor element in which the drive of the male rotor is mounted on the inlet side of this rotor and the synchronisation gearwheels are mounted on the outlet side thereof, and the sole axial bearing of the male rotor is mounted on the outlet side.

An advantage of this is that the sole axial bearing that fulfills the role of a main bearing is mounted in a place away from the dusty environment of the gearwheel transmission and is accommodated under a closing cover in which the synchronisation gearwheels are also accommodated safely separated from the environment.

Moreover, in this case the sole axial bearing of the male rotor is on the other side of the rotor where the drive gearwheel is mounted, such that this sole bearing is much less under the influence of the bending of the shaft of the male rotor that is caused by the radial forces that are exerted on this shaft when being driven by the drive gearwheel, so that the problem of a possible tilting of the axial bearing is thereby resolved.

In addition, the synchronisation gearwheels are on the same side of the rotor as the main bearing, and thus at a short axial distance from the main bearing that fixes the male rotor locally in the axial direction.

This has the advantage that length changes of the rotors due to variable temperature gradients during the operation of the compressor elements only have a small effect on the axial displacement of the synchronisation gearwheels with respect to one another, and consequently only have a small effect on the change of the synchronisation between the male and female rotor that is the consequence of this.

Preferably, the male rotor is radially mounted on two radial bearings, respectively one radial bearing on the inlet side where the drive gearwheel is located and a second radial bearing on the outlet side.

In this way only one radial bearing is provided on the axle journal on which the drive gearwheel is mounted, without an extra axial bearing such as with conventional screw compressors, such that this axial journal can be made shorter with less bending as a result, and the bearing cover on the inlet side can be made less high and thus lighter as, in the case of the invention, only one radial bearing of the male rotor must be supported.

According to a practical embodiment of the invention, a drive is chosen for the male rotor that exerts a drive force on the male rotor with an axial component that is zero or which, if not zero, is directed from the outlet to the inlet, and for the synchronisation gearwheel of this rotor a gearwheel is chosen with an oblique or helical toothing in which the course of the helix of the synchronisation gearwheel and the male rotor have the same direction with respect to the axial direction of the male rotor.

Thus the resulting drive force exerted by the drive and by the synchronisation gearwheels on the male rotor is always directed from the outlet to the inlet and consequently in the same direction as the gas forces, insofar they are present.

To this end the drive of the male rotor is preferably constructed as a drive gearwheel with oblique toothing that is chosen such that the course of the helix of the drive gearwheel and of the male rotor with respect to the axial direction of the male rotor have opposite orientations so that the drive force exerted by the drive gearwheel on the male rotor is directed from the outlet to the inlet.

Alternatively a drive can be chosen with a drive gearwheel with straight toothing which in this way exerts very little or no force on the male rotor.

A direct drive of the male rotor is also one of the possibilities, whereby the male rotor for the drive is directly coupled to the shaft of a motor.

With regard to the female rotor, depending on the mode, the forces occurring can push the female rotor in the one or the other axial direction.

For this reason, the female rotor is axially mounted on bearings in the housing of the compressor element by means of two axial bearings, which preferably, in the case of an inlet-driven compressor element, are both mounted on the outlet side of the female rotor.

This offers equivalent advantages as the mounting of the single axial bearing of the male rotor on the outlet side of an inlet-driven compressor element, i.e. in a protected dust-free environment away from the gearwheel drive and is easily accessible for assembly.

Preferably the axial bearings are mounted on either side of the synchronisation gearwheel of the female rotor, in other words each on a different side of this synchronisation gearwheel, which fosters the stability and reduces the number of components of the construction.

According to a preferred aspect, at least one of the two axial bearings is placed under an axial prestress force, preferably by means of a spring that exerts a prestress force oriented from the outlet to the inlet, in other words in the same direction as the gas forces, such that when there are no or low gas forces when starting up, the prestress force overcomes the axial drive force of the synchronisation gearwheel of the female rotor to prevent the female rotor being able to be pulled against the outlet end face of the housing.

Preferably a prestress force is only exerted on the outermost of the two axial bearings by means of a compression spring that is tightened between this outermost axial bearing and the housing of the compressor element, for example the cover of the synchronisation gearwheels, which facilitates the assembly.

Most preferable of all, a flexible spring is used for the prestressing spring in which the built-in length/rotor length ratio is greater than 8%, whereby the rotor length is defined as the axial length of the helical section of the rotor.

An advantage of such a flexible spring is that with such a spring the prestress force remains relatively constant with the shortening or lengthening of the built-in space.

Preferably the female rotor is additionally mounted on two radial bearings, respectively one on the inlet side and one on the outlet side of the female rotor.

In this way, there are only two bearings on the inlet side of an inlet-driven compressor element, i.e. one radial bearing of the male rotor and one radial bearing of the female rotor.

This enables these two radial bearings to be advantageously integrated in a bearing cover with a limited thickness and mass.

In this case, all other bearings of the male and the female rotor are provided on the outlet side of these rotors in a dust-free protected environment under the cover of the synchronisation gearwheels, away from the gearwheel transmission on the inlet side and easily accessible by detaching this cover.

Thanks to the fact that at the location of the axial bearings almost no bending of the rotor shafts occurs, at this location a smaller diameter of the shaft can be chosen, such that it is possible to select smaller axial bearings that are highly suitable for rotation at high speeds.

A combination of one or more of the different innovative aspects described above enables more favourable load conditions to be obtained for all remaining bearings, excluding the sole axial bearing of the male rotor.

Smaller bearings provide the advantage that they cause lower mechanical losses at the same speed of rotation, which enables a better efficiency to be obtained at the same speed of rotation or enables the speed to be increased.

According to a particular aspect, one or more ceramic axial bearings or hybrid bearings with ceramic balls can be selected that provide the advantage of enabling even higher speeds of rotation.

According to another particular aspect of the invention, for an inlet-driven compressor element the inlet end face of the housing of the compressor element is formed by the bearing cover that is supported on a machined surface of the housing that also acts as a support surface for the housing of the drive.

Thus only one single machined surface is required for the mounting of the bearing cover and the housing of the drive, which simplifies the alignment of the two housings with respect to one another.

This also makes it possible for an input of the cooling jacket of the housing of the compressor element to be directly connected, in other words without the intervention of external pipes, to an output of the internal cooling channels of the housing of the gearwheel transmission.

As a result, the mounting of pipes is avoided and the risk of leaks from the cooling circuit is reduced.

In summary, it is clear that due to a combination of various aforementioned aspects, a compact and efficient compressor element can be obtained with exceptionally low leaks and insofar desired previously unseen high speeds of rotation.

The invention also provides a compressor element of a screw compressor comprising a housing with an inlet for the gas on the inlet side and an outlet for the gas on the outlet side and two rotor chambers in which two helical rotors are mounted on bearings, which when driven mesh together in order to compress the gas, respectively a male rotor with a drive for the male rotor and a female rotor that is driven by the male rotor by means of synchronisation gearwheels with at least one synchronisation gearwheel on the male rotor and one synchronisation gearwheel on the female rotor, with the characteristic that it is an inlet-driven compressor element with a drive of the male rotor on the inlet side of the male rotor and the synchronisation gearwheels on the outlet side of the male rotor, whereby the male rotor is mounted on bearings in the axial direction by only one single axial bearing that is mounted on the outlet side.

This means that the synchronisation gearwheels are at a short axial distance from the sole axial main bearing, with the advantage that the effect of variable temperature gradients on the change of the synchronisation between the male and female rotor is limited as already set out above.

The invention also relates to a screw compressor that is provided with a compressor element according to the invention, whereby this compressor element is driven by a gearwheel transmission with a drive gearwheel on the male rotor that when driven exerts a force on this rotor that has an axial component that is directed from the outlet side to the inlet side.

BRIEF DESCRIPTION OF THE DRAWINGS

With the intention of better showing the characteristics of the invention, a few preferred embodiments of a screw compressor with a compressor element according to the invention are described hereinafter by way of an example, without any limiting nature, with reference to the accompanying drawings, wherein.

DETAILED DESCRIPTION OF THE INVENTION

Figure 1:
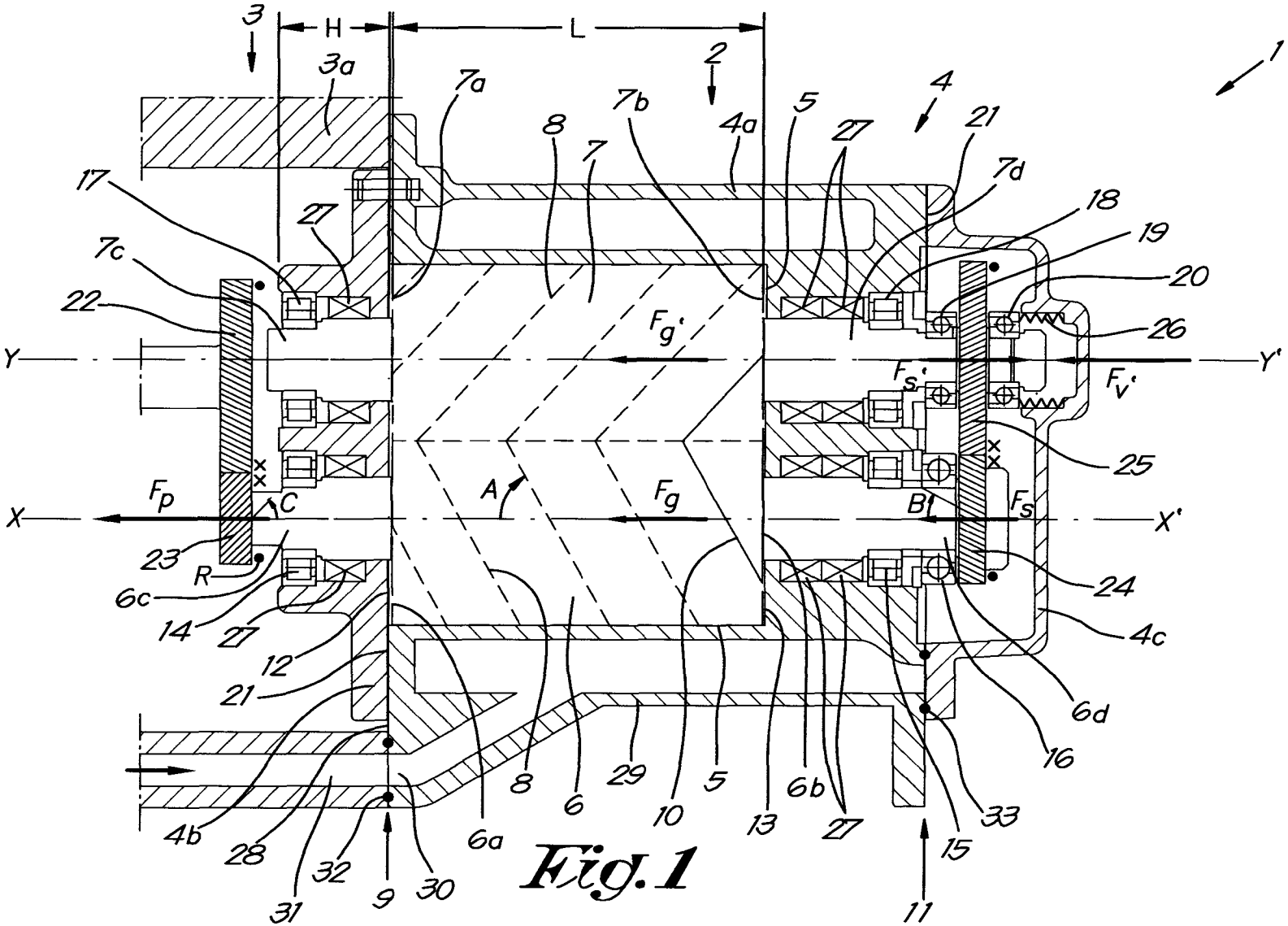
FIG. 1 schematically shows a cross-section of a part of a screw compressor with a compressor element according to the invention.

The screw compressor 1 shown in FIG. 1 comprises a compressor element 2 and a drive in the form of a gearwheel transmission 3, of which only a part is shown for reasons of clarity.

The compressor element 2 is provided with a housing 4 with a central section 4*a* in which two overlapping cylindrical rotor chambers 5 are provided, in which two rotors 6 and 7 are affixed with helical lobes 8, respectively a male rotor 6 and a female rotor 7 whose lobes 8 mesh together in such a way that chambers are separated between the rotors 6 and 7 which, when the compressor element 2 is driven, move in a known way from an inlet, not shown in the drawings, on the inlet side 9 of the rotors 6 and 7 to an outlet 10 on the outlet side 11 of the rotors 6 and 7, whereby during this movement the enclosed gas is compressed.

The axis lines X-X' and Y-Y' of the two rotors 6 and 7 are arranged practically parallel to one another and are held in an axial direction by their respective end faces 6*a* and 6*b* and 7*a* and 7*b*, between an inlet end face 12 of the housing 4 that is formed by a bearing cover 4*b* that forms part of the housing 4 and an outlet end face 13 that in this case is worked directly in the central section 4*a* of the housing 4.

The male rotor 6 is provided with two coaxial axle journals 6*c* and 6*d* by which this rotor 6 is rotatably mounted on bearings in the housing 4, respectively by means of a single radial bearing 14 in the bearing cover 4*b* on the inlet side 9 of the rotor 6 and by means of one radial bearing 15 and one single axial bearing 16 on the outlet side 11, whereby in the case of FIG. 1 this axial bearing 16 is a single-acting bearing by which the rotor 6 is axially fixed to prevent the male rotor 6 being able to be pushed by its end face 6*a* on the inlet side 9 against the inlet end face 12 of the housing 4 due to the forces occurring during the operation of the screw compressor 1.

The female rotor 7 is also provided with two end faces 7*a* and 7*b* and with two coaxial axle journals 7*c* and 7*d*, of which the axle journal 7*c* on the inlet side 9 of the rotor 7 is mounted on bearings by means of one single radial bearing 17, while the other axial journal 7*d* is provided with a radial bearing 18 and two axial bearings 19 and 20.

The housing 4 is provided on the outlet side 11 with a cover 4*c* that is fastened to the central section 4*a* of the housing 4 and under which the bearings 15, 16, 18, 19 and 20 are protected.

Gaskets 21 are affixed between the various parts 4*a*, 4*b* and 4*c* of the housing 4.

It is specific to the invention that the compressor element 2 is an inlet-driven compressor element, which means that the external gearwheel transmission 3 of the compressor element 2 is on the inlet side 9 and not on the outlet side as is usual.

In the example shown, this gearwheel transmission 3 is schematically shown as a gearwheel transmission of which only a part 3*a* of the housing is shown and as two gearwheels 22-23 with oblique toothing that mesh together and of which one gearwheel 23, the 'drive gearwheel', is fastened directly to the axle journal 6*c* of the male rotor 6. The drive gearwheel 23 can be seen as forming part of the compressor element 2 or as forming part of the gearwheel transmission 3.

The female rotor 7 is driven by the male rotor 6 by means of synchronisation gearwheels on the outlet side 11, in this case two synchronisation gearwheels 24 and 25 with oblique toothing that mesh together and of which one gearwheel 24 is fastened to the axle journal 6*d* of the male rotor 6 and the other gearwheel 25 on the axle journal 7*d* of the female rotor 7. The transmission ratio is chosen such that the male rotor 6 drives the female rotor 7 at a lower speed.

The synchronisation gearwheels 24-25 are protected from the environment by means of the aforementioned cover 4*c*.

The synchronisation gearwheel 25 of the female rotor 7 is flanked by the aforementioned axial bearings 19 and 20 of the female rotor 7, whereby these bearings 19 and 20 are thus each on a different side of this synchronisation gearwheel 25.

On the bearing 20 most oriented towards the outside of these two axial bearings 19 and 20, an axial prestress is exerted by means of a spring 26 that is tightened between the bearing 20 concerned and the cover 4*c*.

This spring 26 is preferably a flexible spring whose length changes have little effect on the prestress force exerted.

Flexible spring means a spring whose built-in length to rotor length ratio is greater than 8%, with the rotor length L being defined as the axial length of the helical section of the rotor or in other words the axial distance between the end faces of a rotor concerned.

As is usual the rotors 6 and 7 are sealed by means of seals 27.

According to a particular aspect of the invention, the choice of an inlet-driven compressor element 2 enables the central section 4*a* of the housing 4 on the inlet side 9 to be provided with one single machined surface 28, that acts both as a mounting surface 28 for the bearing cover 4*b* on the inlet side 9 and acts as a mounting surface 28 for the housing 3*a* of the gearwheel transmission 3, e.g., the drive, which facilitates the axial alignment between the two housings 4 and 3*a*.

The central section 4*a* of the housing of the compressor element 2 is provided with a cooling jacket 29 with an inlet 30, which in the case of FIG. 1 connects to an internal cooling channel 31 of the gearwheel transmission 3, whereby this connection is sealed by a simple O-ring 32.

The operation of the device 1 is very simple and as follows.

When the compressor element 1 is driven in the direction of rotation shown by the arrows R in FIG. 1, gas is drawn in a known way due to the meshing of the rotors 6 and 7 via the inlet of the compressor element 2 and after compression is pushed away via the outlet 10.

As a result of the compression, the male rotor 6 and the female rotor 7 experience a gas force with an axial component Fg and Fg' that is directed from the outlet side 11 where a higher pressure prevails to the inlet side 9 where a lower pressure prevails.

Furthermore, the rotors 6 and 7 experience forces that are due to the mechanical drive forces that are exerted on the rotors 6 and 7 by the gearwheels 23, 24 and 25, more in particular forces with an axial component Fp and Fs that are exerted respectively by the drive gearwheel 23 and the synchronisation gearwheel 24 on the male rotor 6 and the axial force Fs' that is exerted by the other synchronisation gearwheel 25 on the female rotor 7, both in the case of a start-up disregarding the effect of the gas forces, in other words in hypothetical circumstances whereby the rotors 6 and 7 are accelerated without a pressure build-up and thus without gas forces, for example in the event of the rotor chamber 5 of the housing 4 of the compressor element 2 being opened.

According to the invention, the course of the oblique toothing of the oblique gearwheels 23 and 24 of the male rotor 6 are chosen such that the axial forces Fp and Fs act in the same direction as the aforementioned axial gas force Fg, so that the male rotor 6 only experiences forces that tend to push the rotor 6 in the direction of the inlet side 9.

The axial bearing 16 of the male rotor 6 thereby prevents the end face 6*a* of the male rotor 6 being able to come into contact with the inlet end face 12 of the housing 4 without other means being necessary to this end in the form of a spring, plunger or other compensation means.

In order to bring this about, in FIG. 1 an oblique toothing is chosen whereby the course of the helix of the drive gearwheel 23 and the helix of the male rotor 6 with respect to the axial direction X-X' of the male rotor 6 are oriented in opposite directions, while the course of the helix of the synchronisation gearwheel 24 and the helix of the male rotor 6 have the same orientation with respect to the axial direction X-X' of the male rotor 6. In other words, this means that when the smallest included angle A measured from the axial direction X-X' to the tangential direction of the helical lobes 8 of the male rotor 6 is positive, or in other words oriented in the clockwise direction, and that the smallest included angle B measured from the axial direction X-X' to the oblique toothing of the synchronisation gearwheel 24 is positive, or in other words also oriented in the clockwise direction, while the included angle C measured from the axial direction X-X' to the oblique toothing of the drive gearwheel 23 is negative, or thus oriented in the anticlockwise direction.

Of course the synchronisation gearwheel 25 of the female rotor 7 presents a toothing that is complementary to that of the synchronisation gearwheel 24 of the male rotor 6, from which it follows that the axial force Fs' exerted on the female rotor 7 by the synchronisation gearwheel 25 is opposite to the axial gas force Fg' exerted on the female rotor 7 when the screw compressor 1 runs under a load.

Furthermore, the female rotor 7 experiences an axial force Fv' as a result of the prestress of the spring 26 that is directed opposite to the force Fs' of the synchronisation gearwheel 25 and which is chosen such that in the unloaded state the gas force Fg' is eliminated, the prestress force Fv' at least compensates the remaining force Fs'.

It is clear that the cover 4*c* on the outlet side 11 is easily detachable, such that all axial bearings 16, 19 and 20, as well as the radial bearings 15 and 18 and the synchronisation gearwheels 24 and 25 and the prestress spring 26 are easily accessible for assembly and/or inspection.

The thickness H and the mass of the bearing cover 4*b* on the inlet side 9 is relatively limited, as only two radial bearings 14 and 17 have to be accommodated. Moreover, this bearing cover 4*b* is mounted in the housing 3*a* of the gearwheel transmission 3, which means a saving of the axial length of the screw compressor 1 compared to existing screw compressors with a similar capacity.

In the event of a leak at the location of the O-ring 32 there is only a risk of coolant leaking into the gearwheel transmission, such that the oil of this gearwheel transmission can be spoiled, but which is less catastrophic than when a leak occurs in the same place in the known compressor elements, whereby in such a case coolant could penetrate into the rotor chambers 5 of the compressor element 2, resulting in the immediate stoppage of the compressor element 2.

Figure 2:
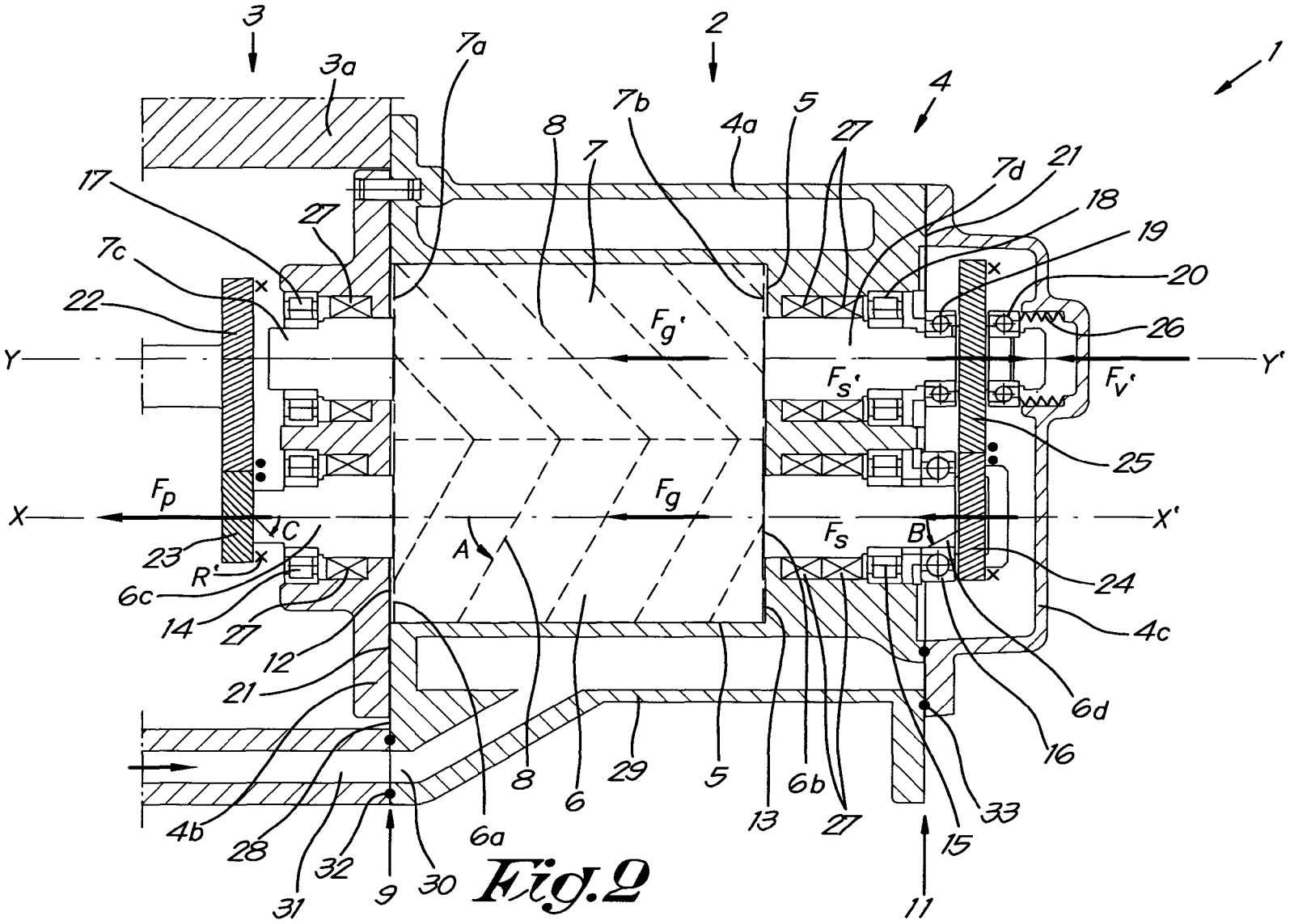
FIG. 2 shows a cross-section such as that of FIG. 1, but for a variant embodiment.

For the same reason, no seals are provided between the cooling channel 30 and the cover 4*b*. Any openings that are needed to realise the cooling channels in the cast cooling jacket 29 are sealed between the cooling jacket 29 and the cover 4*c*. The seal 33 in FIG. 1 is an example of this. FIG. 2 shows a variant of a compressor element 2 according to the invention, whereby in this case the change of the pitch of the helix of the male rotor 6 is oriented in the opposite direction to a 'left-handed helix' instead of the right-handed helix of the male rotor 6 of FIG. 1.

The course of the direction of the oblique toothing of the drive gearwheel 23 and the synchronisation gearwheels 24 and 25 are in this case opposite to ensure that all forces Fp, fs and Fg that are exerted on the male rotor 6 are oriented from the outlet side 11 to the inlet side 9.

It goes without saying that instead of gearwheels 22 to 25 with oblique toothing, helical or straight gearwheels or other forms of direct or indirect drive can be applied, which when driven are able to exert an axial force on the rotors 6 and 7 or which, if applicable, exert an axial force on the male rotor that is small or even zero.

The axial bearings 16, 19 and 20 can be single-acting or double-acting, but the single-acting bearings offer the advantage of being more efficient. The axial bearings can also be a bearing with ball-centered cage.

It is clear that an inlet-driven compressor element 2 offers certain advantages with respect to the conventional outlet-driven compressor elements and that this aspect can also be applied independently, separate from the other characteristics that are included in the description.

It is clear that a number of axial and radial bearings can be applied other than those described above, but that this can bring about extra losses.

It is also clear that the prestress force Fv' can also be realised by other means than a spring 26, for example by magnetic interaction or with a plunger. It is not excluded that there are intermediate gearwheels between the synchronisation gearwheels 24 and 25 of the male rotor 6 and of the female rotor 7 for the drive of the female rotor by the male rotor.

In the discussion of the forces account was only taken of the axial component of the exerted forces, although a radial component is also possible. The term force or axial force thus always means the axial component of the force concerned.

The present invention is by no means limited to the embodiments described as an example and shown in the drawings, but a compressor element and screw compressor according to the invention can be realised in all kinds of forms and dimensions without departing from the scope of the invention.

The invention claimed is:

1. A compressor element of a screw compressor for compressing gas, with the compressor element comprising:

a housing with an inlet for the gas on an inlet side, and an outlet for the gas on an outlet side; and two rotor chambers in which two helical rotors are mounted on bearings that upon being driven mesh together in order to compress the gas, said two helical rotors comprising a male rotor with a drive for rotating the male rotor and a female rotor that is driven by the male rotor by means of synchronisation gearwheels with at least one synchronisation gearwheel on the male rotor and one synchronisation gearwheel on the female rotor, wherein the drive and the synchronisation gearwheels of the male rotor are chosen such that, upon being driven with acceleration of the rotors of the compressor element without gas forces, a resulting mechanical drive force that is exerted by the drive and by the synchronisation gearwheel on the male rotor has an axial component that is directed in an axial direction from the outlet side to the inlet side and that a movement of the male rotor in the axial direction from the outlet side to the inlet side is fixed by means of a single axial single-acting bearing, and wherein the compressor element is an inlet-driven compressor element with the drive of the male rotor on the inlet side of the male rotor and the synchronisation gearwheels on the outlet side of the male rotor and that the single axial bearing of the male rotor is mounted on the outlet side.

2. The compressor element according to claim 1, wherein there are no force-compensating means for the male rotor that are intended to exert a force in an axial direction on the male rotor.

3. The compressor element according to claim 1, wherein the male rotor is radially mounted on bearings by means of two radial bearings, respectively one radial bearing on the inlet side of the rotor and one radial bearing on the outlet side.

4. The compressor element according to claim 1, wherein the drive is such that, when the compressor element is driven, it exerts little or no axial force on the male rotor or an axial force that is directed from the outlet side to the inlet side.

5. The compressor element according to claim 4, wherein the drive on the male rotor comprises a drive gearwheel with an oblique or helical toothing of which a pitch of the oblique or helical toothing is oriented opposite to a pitch of the helix of the male rotor with respect to the axial direction of the male rotor.

6. The compressor element according to claim 1, wherein at least one axial bearing is a bearing with ball-centred cage.

7. The compressor element according to claim 1, wherein at least one axial bearing is a hybrid bearing with ceramic balls.

8. The compressor element according to claim 1, wherein an inlet end face of the housing of the compressor element is formed by a bearing cover that is supported on a machined mounting surface of the housing that also acts as a mounting surface for a housing of the drive.

9. The screw compressor comprising the compressor element according to claim 1 that is driven by means of the drive on the male rotor, whereby the drive exerts a force on the male rotor that has the axial component that is directed from the outlet side to the inlet side of the male rotor or which is equal to zero.

10. A compressor element of a screw compressor for compressing gas, with the compressor element comprising:

a housing with an inlet for the gas on an inlet side, and an outlet for the gas on an outlet side; and two rotor chambers in which two helical rotors are mounted on bearings that upon being driven mesh together in order to compress the gas, said two helical rotors comprising a male rotor with a drive for rotating the male rotor and a female rotor that is driven by the male rotor by means of synchronisation gearwheels with at least one synchronisation gearwheel on the male rotor and one synchronisation gearwheel on the female rotor, wherein the drive and the synchronisation gearwheels of the male rotor are chosen such that, upon being driven with acceleration of the rotors of the compressor element without gas forces, a resulting mechanical drive force that is exerted by the drive and by the synchronisation gearwheel on the male rotor has an axial component that is directed in an axial direction from the outlet side to the inlet side and that a movement of the male rotor in the axial direction from the outlet side to the inlet side is fixed by means of a single axial single-acting or double-acting bearing, wherein the synchronisation gearwheel of the male rotor is provided with an oblique or helical toothing, whereby a pitch of the oblique or helical toothing of the synchronisation gearwheel and a pitch of the helix of the male rotor with respect to the axial direction of the male rotor have the same orientation.

11. A compressor element of a screw compressor for compressing gas, with the compressor element comprising:

a housing with an inlet for the gas on an inlet side, and an outlet for the gas on an outlet side; and two rotor chambers in which two helical rotors are mounted on bearings that upon being driven mesh together in order to compress the gas, said two helical rotors comprising a male rotor with a drive for rotating the male rotor and a female rotor that is driven by the male rotor by means of synchronisation gearwheels with at least one synchronisation gearwheel on the male rotor and one synchronisation gearwheel on the female rotor, wherein the drive and the synchronisation gearwheels of the male rotor are chosen such that, upon being driven with acceleration of the rotors of the compressor element without gas forces, a resulting mechanical drive force that is exerted by the drive and by the synchronisation gearwheel on the male rotor has an axial component that is directed in an axial direction from the outlet side to the inlet side and that a movement of the male rotor in the axial direction from the outlet side to the inlet side is fixed by means of a single axial single-acting or double-acting bearing, wherein the female rotor is mounted on axial bearings in the housing by means of two axial bearings that are both mounted on the outlet side of the female rotor and which together block the female rotor in the axial direction, both from the inlet side to the outlet side and from the outlet side to the inlet side.

12. The compressor element according to claim 11, wherein the axial bearings are mounted on either side of the synchronisation gearwheel of the female rotor.

13. The compressor element according to claim 12, wherein at least one of the two axial bearings is placed under an axial prestress that exerts a prestress force that is directed from the outlet side to the inlet side.

14. The compressor element according to claim 13, wherein a prestress is only exerted on the outermost bearing of the two axial bearings by means of a spring that is tightened between this outermost axial bearing and the housing of the compressor element.

15. The compressor element according to claim 13, wherein a flexible spring is used for the prestress spring whose built-in length/rotor length ratio is greater than 8%, with the rotor length being defined as an axial length of the helical section of the rotor.

16. The compressor element according to claim 11, wherein the female rotor is additionally mounted on bearings by means of two radial bearings, one on the inlet side and one on the outlet side of the female rotor.

17. A compressor element of a screw compressor for compressing gas, with the compressor element comprising:

a housing with an inlet for the gas on an inlet side and an outlet for the gas on an outlet side; and two rotor chambers in which two helical rotors are mounted on bearings, which when driven mesh together to compress the gas, said two helical rotors comprising a male rotor with a drive for rotating the male rotor and a female rotor that is driven by the male rotor by means of synchronisation gearwheels with at least one synchronisation gearwheel on the male rotor and one synchronisation gearwheel on the female rotor, wherein the compressor element is an inlet-driven compressor element with the drive of the male rotor on the inlet side of the male rotor and the synchronisation gearwheels on the outlet side of the male rotor and that the male rotor is mounted on bearings so that movement of the male rotor in an axial direction from the outlet side to the inlet side is axially fixed by only one single axial bearing that is mounted on the outlet side.

18. The screw compressor comprising the compressor element according to claim 17 that is driven by means of the drive on the male rotor, whereby the drive exerts a force on the male rotor that has the axial component that is directed from the outlet side to the inlet side of the male rotor or which is equal to zero.

* * * * *